US005722354A

United States Patent [19]

Sansoucy

[11] Patent Number: 5,722,354

[45] Date of Patent: Mar. 3, 1998

[54] HEAT RECOVERY STEAM GENERATING APPARATUS

[75] Inventor: Donald M. Sansoucy, Providence, R.I.

[73] Assignee: DB Riley, Inc., Worcester, Minn.

[21] Appl. No.: 569,285

[22] Filed: Dec. 8, 1995

[51] Int. Cl.[6] ..... F22B 37/24

[52] U.S. Cl. ..... 122/510; 165/67

[58] Field of Search ..... 122/510, 494, 122/6 A; 165/67, 69, 82

[56] References Cited

U.S. PATENT DOCUMENTS

| | | | |
|---|---|---|---|
| 1,830,185 | 11/1931 | Bancel . | |
| 2,654,352 | 10/1953 | Schoenfeld . | |
| 3,292,599 | 12/1966 | Zimmerman | 122/510 |
| 3,368,535 | 2/1968 | Svendsen et al. | 122/510 |
| 3,379,177 | 4/1968 | Stalph | 122/510 |
| 3,479,994 | 11/1969 | Kreider et al. . | |
| 3,608,525 | 9/1971 | Sharan | 122/6 A |
| 3,850,149 | 11/1974 | Piaskowski | 122/494 |
| 4,008,691 | 2/1977 | Kreider et al. | 122/494 |
| 4,286,549 | 9/1981 | Eisinger | 122/510 |
| 4,427,058 | 1/1984 | Bell, Sr. et al. | 165/160 |
| 4,428,329 | 1/1984 | Rees | 122/510 |
| 5,339,891 | 8/1994 | Kidaloski et al. | 165/67 |
| 5,341,869 | 8/1994 | Kidaloski et al. | 165/67 |
| 5,379,588 | 1/1995 | Tomlinson et al. | 60/39.182 |

*Primary Examiner*—William Doerrler

*Attorney, Agent, or Firm*—Mason, Kolehmainen, Rathburn & Wyss

[57] ABSTRACT

A new and improved heat recovery steam generating apparatus for extracting heat from a hot gas stream, comprises a vertically extending tube bank having upper and lower headers at opposite ends. Two pairs of external, gravity force, support columns are spaced upstream and downstream of the tube bank and a top support structure is mounted at the upper end of the columns for supporting the tube bank in downwardly hanging relation from the upper header. A pair of permanent internal trusses are supportively connected at the upper end to the columns and each truss has opposite edges slidably supported from a pair of columns for accommodating expansion and contraction of the tubes and for transferring and resisting lateral and shear loads, which loads are eventually transferred to a bottom structure at the lower end of the columns. Tube spacing elements are provided at several different levels at oppositely spaced apart intervals and the sheets are supported on side members extending between the trusses for maintaining alignment of the tubes and for transferring lateral loads to the trusses. The trusses are useful in preventing damage and distortion of the tube bank during transport and erection, and then become a permanent part of the HRSG structure when erection is completed.

17 Claims, 4 Drawing Sheets

HEAT RECOVERY STEAM GENERATING APPARATUS

BACKGROUND OF THE INVENTION 1. Field of the Invention

The present invention relates to a new and improved heat recovery steam generating (HRSG) apparatus and more particularly to such apparatus having an internal truss bracing system. Because, in typical applications, heat recovery steam generating systems are often larger and cumbersome, it is desirable to provide a modular system for easier shipment and transport from the fabrication site to the installation site. Moreover, the internal truss bracing system in accordance with the present invention is used during shipment, transport and on-site erection to avoid module distortion and damage. Heretofore, the steel used for bracing and protection during shipment had to be removed and then discarded at the erection site. The heat recovery system of the present invention utilizes an internal truss bracing system for protection of the module during shipment, for bracing during field erection, and the truss system often with little or no modification, becomes a permanent part of the installation.

2. Background of the Prior Art

Bancel U.S. Pat. No. 1,830,185 discloses a condenser having water boxes at opposite ends supported on posts secured with cross-braces.

Schoenfeld U.S. Pat. No. 2,654,352 discloses a support and casing structure for a steam generator employing a column of stacked box-like frames.

Kreider et al. U.S. Pat. No. 3,479,994 discloses an enclosure for a steam generator including a wrapper mounted on the furnace walls for relative movement with respect thereto and trusses supporting the wrapper and interconnected thereby.

Sharan U.S. Pat. No. 3,608,525 discloses a prefabricated structural support unit defining heating surfaces of a vapor generator.

Kreider et al. U.S. Pat. No. 4,008,691 discloses a support system for a vapor generator for protecting the walls from stresses due to thermal expansion of end sections and plenums.

Bell, Sr. et al. U.S. Pat. No. 4,427,058 discloses a side wall baffle for a heat recovery steam generator which reduces heat loss due to gas flow along heat exchanger walls.

Kidaloski et al. U.S. Pat. Nos. 5,339,891 and 5,341,869 disclose modular heat exchanger units with top supported high temperature heating surface modules and a permanent supporting structural frame.

Tomlinson et al. U.S. Pat. No. 5,379,588 discloses a heat recovery steam generator for reheating steam/condensate from a steam turbine having a superheater and a reheater with the superheater positioned to present the first heat exchange surface to the incoming hot gases from the turbine.

OBJECTS OF THE INVENTION

It is an object of the present invention to provide a new and improved heat recovery steam generator and more particularly, a modular steam generator employing internal trusses for protecting the modules against damage and distortion during shipment from a fabrication site to an erection or installation site, and during the erection process at the installation site.

Yet another object of the present invention is to provide a new and improved HRSG apparatus of the character described that is braced with internal trusses inside of a column outer support system, which trusses become a permanent part of the apparatus when erection is completed.

Still another object of the present invention is to provide a new and improved HRSG apparatus of the character described wherein a bank of tubes is supported from the top end and wherein internal trusses are provided upstream and downstream from the tube bank for resisting lateral stress and transferring shear stress to an external column support structure.

A further object of the present invention is to provide a new and improved HRSG apparatus of the character described which uses permanent steel trusses for shipping and erection that would normally be classified only as temporary bracing requiring removal and discarding after erection is completed.

Another object of the present invention is to provide a new and improved HRSG apparatus of the character described, which utilizes structural steel trusses and connectors for reducing overall weight and cost by providing multi-functional uses of the steel for shipping, for erection, and for permanent support after erection is completed.

BRIEF SUMMARY OF THE PRESENT INVENTION

The foregoing and other objects and advantages of the present invention are accomplished in a new and improved heat recovery steam generating apparatus for extracting heat from a hot gas stream, comprising a vertically extending tube bank having upper and lower headers at opposite ends. Pairs of external, gravity force, support columns are spaced upstream and downstream of the tube bank and a top support structure is mounted at the upper end of the columns for supporting the tube bank in downwardly hanging relation from the upper header. A pair of permanent internal trusses are supportively connected at the upper end to the columns and each truss has opposite edges slidably supported from a pair of columns for accommodating expansion and contraction of the tubes and for transferring and resisting lateral and shear loads, which loads are eventually transferred to a bottom structure at the lower end of the columns. Tube spacing sheets are provided at plural levels in vertically spaced apart, horizontally parallel relation and these sheets are supported on side members extending between the trusses for maintaining alignment of the tubes in the tube bank and transferring lateral loads to the trusses.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 1:
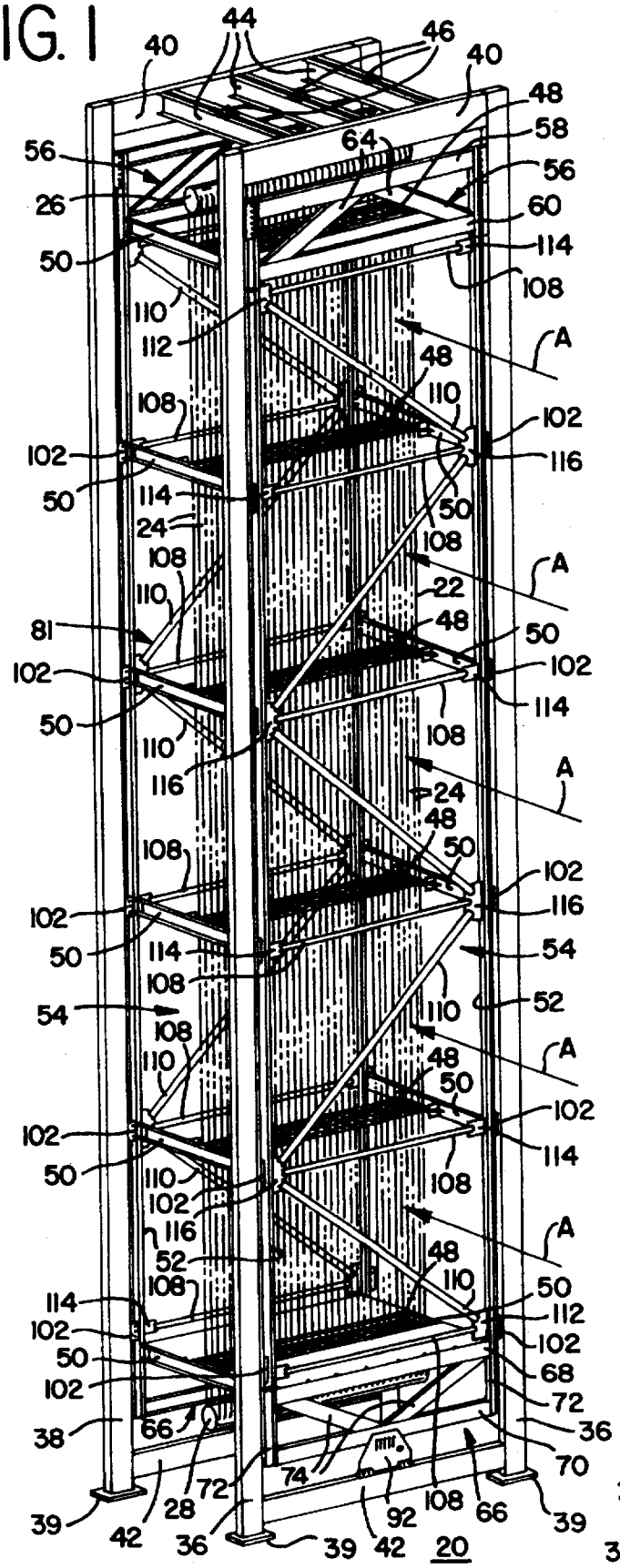
FIG. 1 is an elevational isometric view from an upstream side of a new and improved heat recovery steam generator apparatus constructed in accordance with the features of the present invention and illustrated in an erected condition but without side panels.
Figure 2:
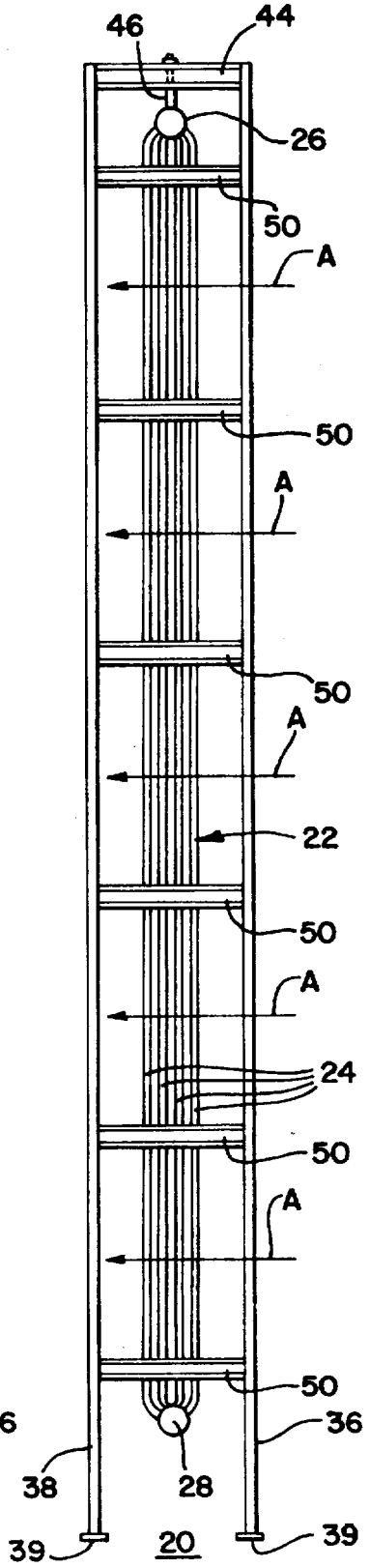
FIG. 2 is a side elevational view of the apparatus.

Referring now more particularly to the drawings, in FIGS. 1 and 2 is illustrated a new and improved HRSG apparatus constructed in accordance with the features of the present invention and referred to generally by the reference numeral 20. The HRSG apparatus 20 as illustrated in FIGS. 1 and 2 does not show top, bottom and opposite side walls for containing a flow of high temperature exhaust gas, flue gas, etc., which moves through the apparatus from right to left as indicated by the arrows A.

Heat from the high temperature gas flow is given up to a vertically extending tube bank 22 of water/steam tubes 24 interconnected at upper and lower ends, respectively, to an upper header 26 and a lower header 28 extending transversely to the direction of gas flow (arrows A) between opposite, insulated side wall panels 30 (FIGS. 3 and 4) of the HRSG apparatus 20 below and above, respectively, insulated top and bottom wall panels 32 and 34.

The weight of the tube bank 22 and the headers 26 and 28 is supported from the ground or other base structure by means of an upstream pair of external, vertical columns 36 and a similar downstream pair of external, vertical columns 38. Each column 36 and 38 is provided with a base plate 39 at the lower end for spreading the gravity loading over a larger area to a supporting base. Upper ends of each pair of vertical columns 36 and 38 are structurally interconnected by upper cross-members 40 above and parallel to the upper header 26. Lower ends of each pair of vertical columns 36 and 38 are structurally interconnected by lower cross-members 42 below and parallel to the lower header 28.

The upper cross-members 40 are interconnected by a plurality of spaced apart header supports 44 extending parallel to the general direction of gas flow indicated by the arrows A. The tube bank 22 including all of the tubes 24 and the headers 26 and 28 is supported to hang from the supports 44 by means of vertical hangers 46 interconnected between the upper header 26 and the individual header supports 44 as illustrated. As the tube bank 22 is heated and cooled during operation, the elongated tubes 24 extend in length and contract accordingly, and the lower header 28 correspondingly moves down and up relative to the supports at the upper end of the tube bank.

During operation, the spacing interval between individual tubes 24 of the tube bank 22 is maintained by means of horizontal, perforated spacer structures 48 at vertically spaced apart appropriate levels along the height of the tube bank. The spacer structures 48 comprise a plurality of elongated elements having semicircular openings spaced along the edges so that openings on an adjacent element forms spaced apart circular openings for accommodating the tubes 24. The individual tubes 24 are free to extend and contract in length in a vertical or longitudinal direction but are restrained against relative lateral movement in a horizontal direction by the tray-like spacer structures 48 so that the spacing between adjacent individual tubes is essentially maintained and not constricted to choke off the flow of hot gases moving around the tubes.

The elongated spacer elements of each tray-like spacer structure 48 are supported at opposite ends by a pair of horizontal channel members 50 which contain the spacer elements loosely to permit expansion and contraction. Each channel member 50 in turn is supported at opposite ends from a vertically extending chord 52 of a pair of vertically extending, internal, upstream and dowhstream bracing trusses 54 mounted between the pairs of upstream and downstream external columns 36 and 38.

Each internal, vertically extending, bracing truss 54 is supported at an upper end from an upper, horizontal, cross-truss or top structure 56 extending between a respective pair of external support columns 36 and 38. The upper cross-trusses or top structures 56 each include upper and lower spaced apart, horizontal chords 58 and 60 joined at opposite ends by vertical end members 62 and angularly sloping diagonals 64 extend upwardly and inwardly from lower outer corners of the truss to join the upper chord member 58 at the center (FIGS. 1 and 3).

At the lower end, each internal bracing truss 54 is secured to a lower, horizontal, cross-truss or bottom structure 66 extending between a respective pair of external support columns 36 and 38. The lower cross-trusses or bottom structures 66 each include an upper horizontal chord 68 and a parallel spaced apart, horizontal lower chord 70. The chords 68 and 70 are interconnected at opposite ends to vertically extending end members 72 aligned with and secured to the chords 52 of the internal vertical bracing trusses 54. The lower cross-trusses 66 are provided with angularly sloping diagonals 74 extending downwardly and inwardly from upper corners of the cross-truss to join the lower chord 70 at the center.

Figure 3:
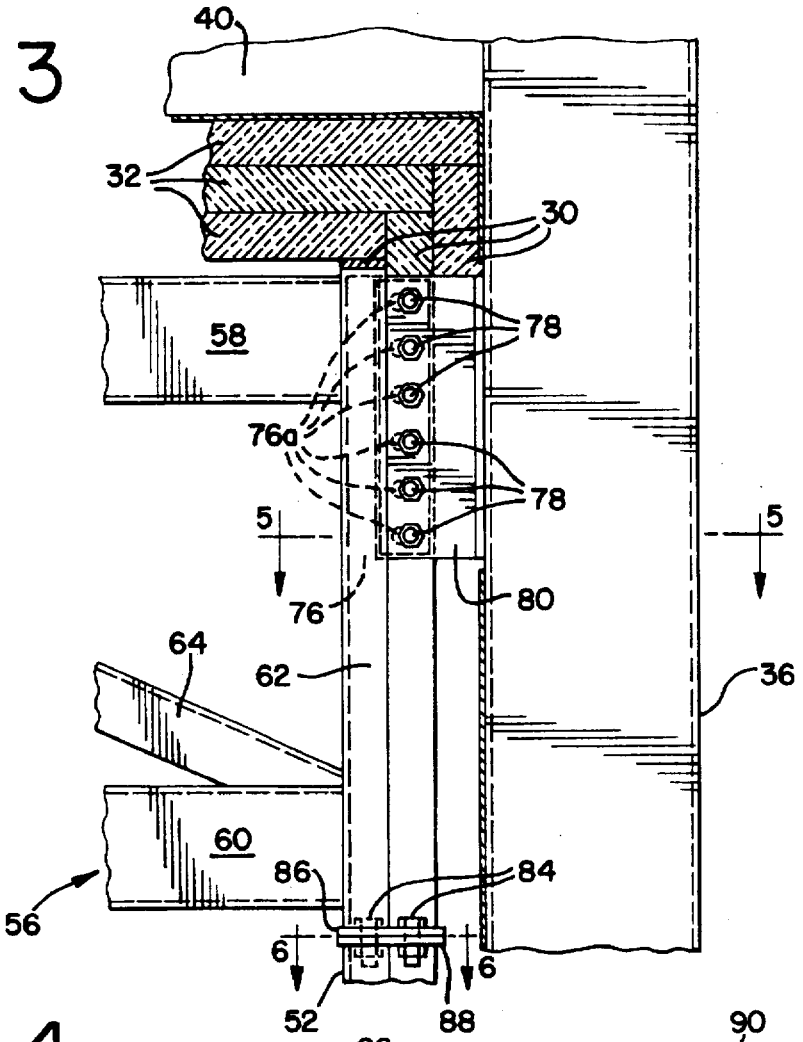
FIG. 3 is a fragmentary, enlarged, detailed elevational view of an interconnecting apparatus between the upper end of a column a top structure thereof and an upper end of an internal truss of the apparatus.
Figure 5:
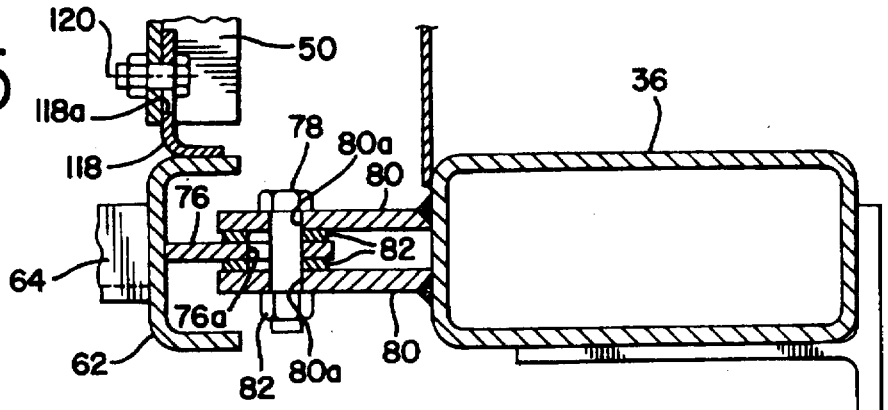
FIG. 5 is a fragmentary, cross-sectional view, taken substantially along lines 5—5 of FIG. 3.

Referring now to FIGS. 3 and 5, the top cross-chords 56 are supported from the respective pairs of external columns 36 and 38 from the end members 62 thereof. These end members 62 comprise channels having a center rib 76 projecting outwardly from the web of the channel toward an adjacent external column 36 or 38. An outer edge portion of each rib 76 is formed with a plurality of vertically spaced apart, elongated, horizontal slots 76*a* for receiving headed anchor bolts 78 with shanks extending through the slots and through circular openings 80*a* provided in a pair of spaced apart brackets 80 positioned in sandwiching relationship on opposite sides of the rib 76. As shown in FIG. 5, slotted strengthening spacers 82 are also provided on opposite faces of the rib 76 between the brackets 80 and a nut 82 is threaded onto each of the bolts 78 to secure a rib 76 between each pair of brackets mounted on the columns 36 and 38.

From the foregoing description, it will be seen that the structural joint interconnection between the external columns 36 and 38 and the adjacent end members 52 of each upper cross-truss 56 positively secures the cross-truss against vertical displacement on the columns while the slotted ribs 76 and spacers 82 permit limited expansion and contraction of the cross-trusses between the pairs of external columns to accommodate relative heating and cooling of the elements of the upper cross-trusses during operation of the HRSG 20.

Referring to FIGS. 1, 3, 6 and 7, the vertical, internal, bracing trusses 54 are connected to hang downwardly from the upper cross-trusses 56 and in turn the upper cross-trusses are supported at opposite ends from the pairs of external support columns 36 and 38. The external columns 36 and 38 carry the vertical load or gravity weight of the upper cross-trusses 56 and a module 81 comprising the tube bank 22, the internal bracing trusses 54, the interconnecting channel elements 50, the tray-like tube spacers 48. The module 81 remains in place during shipment or transport after initial fabrication, during the on-site erection process and remains in the HRSG 20 during operation. The internal bracing trusses 54 and the interconnecting channels 50 provide protection and prevent damage to the tube bank 22 during shipment and erection on-site and then continue to brace and transfer stresses in an efficient manner during actual operation of the HRSG 20.

Figure 6:
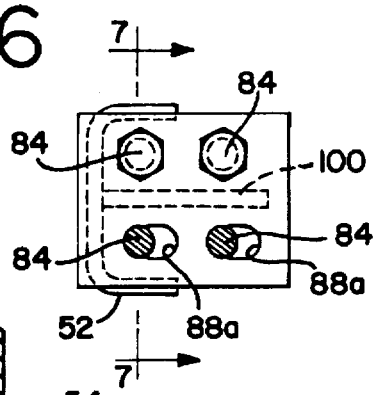
FIG. 6 is a fragmentary, cross-sectional view, taken substantially along lines 6—6 of FIG. 3.
Figure 7:
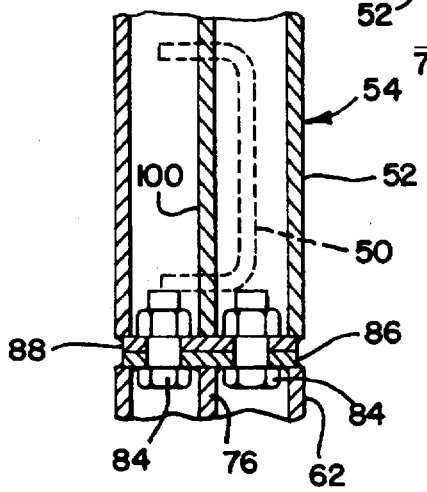
FIG. 7 is a fragmentary, cross-sectional view, taken substantially along lines 7—7 of FIG. 6.

The upper end of the vertical chords 52 of each internal bracing truss 54 is connected to the lower end of an end member 62 of the upper cross-truss 56 by a plurality of tension bolt and nut assemblies 84 as shown best in FIGS. 6 and 7. Heads of the bolts in the bolt and nut assemblies 84 rest on top of a lower end plate 86 welded to the lower end of each end member 62 of the cross-trusses 56. Shanks of the bolts pass downwardly through openings in the end plate 86 and through slots 88*a* formed in upper end plates 88 welded to the upper ends of the vertical chords 52 of the internal bracing trusses 54. Nuts are threaded onto the lower ends of the shanks of the bolts of the nut and bolt assemblies 82 and the nuts bear upwardly against the end plates 88 to hold the plates 86 and 88 together against relative vertical displacement, thus forming a vertical, hanging interconnection between the supporting upper cross-trusses 56 and the module 81. The slots 88*a* permit relative horizontal displacement between the end plates 86 and 88 to accommodate lateral expansion and contraction differences between the upper cross-trusses 56 and the upper ends of the internal bracing trusses 54.

Figure 4:
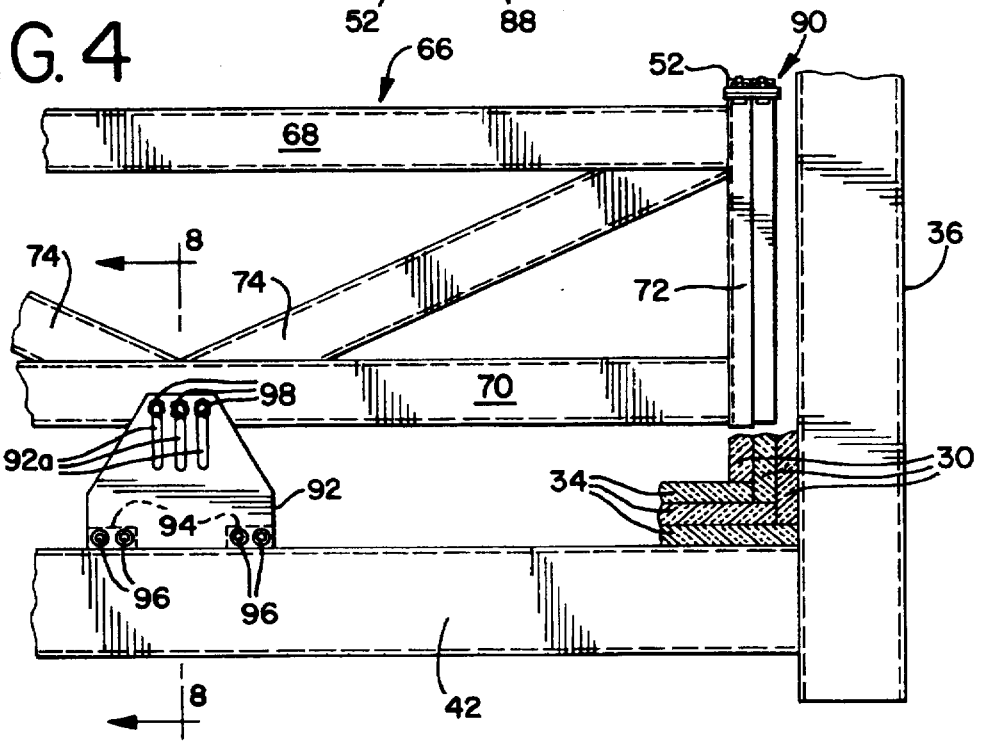
FIG. 4 is a fragmentary, enlarged, detailed elevational view of an interconnecting apparatus between the lower end of a column, a lower end or bottom structure and a lower end of an internal truss of the apparatus.
Figure 8:
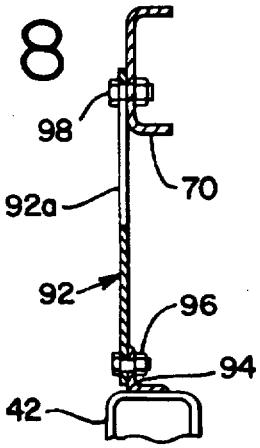
FIG. 8 is a fragmentary, cross-sectional view, taken substantially along lines 8—8 of FIG. 4.

Referring momentarily to FIG. 4, similar interconnecting joints 90 are provided between the upper ends of the vertical end members 72 of the lower cross-trusses 66 and the lower ends of the chords 52 of the vertical internal bracing trusses 54. Accordingly, the lower, horizontal cross-trusses 66 are supported to hang from the lower end of the vertical internal bracing trusses 54. The lower chord 70 of each lower cross-truss 66 is secured to a lower cross-member 42 extending between pairs of external columns 36 and 38 by means of an upstanding shear transfer plate 92 secured to an upper surface of the cross-member at the center by means of angle brackets 94 and bolt and nut assemblies 96 (FIG. 8). An upper portion of the shear transfer plate 92 is formed with a plurality of vertically extending, horizontally spaced slots 92*a* (FIG. 4) and a nut and bolt assembly 98 is provided in each slot to secure the chord 70 against horizontal displacement relative to the shear transfer plate while the slots continue to permit relative vertical displacement.

Figure 10:
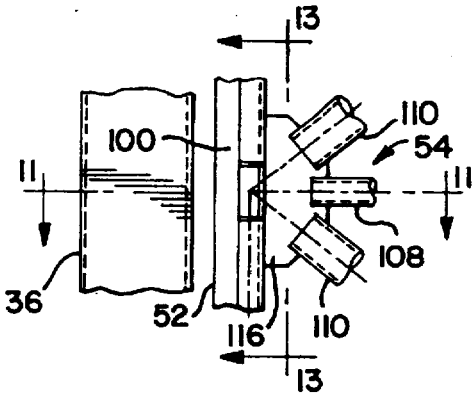
FIG. 10 is a fragmentary, enlarged, detailed elevational view illustrating interconnection apparatus for intermediate level truss diagonals of the chord.
Figure 11:
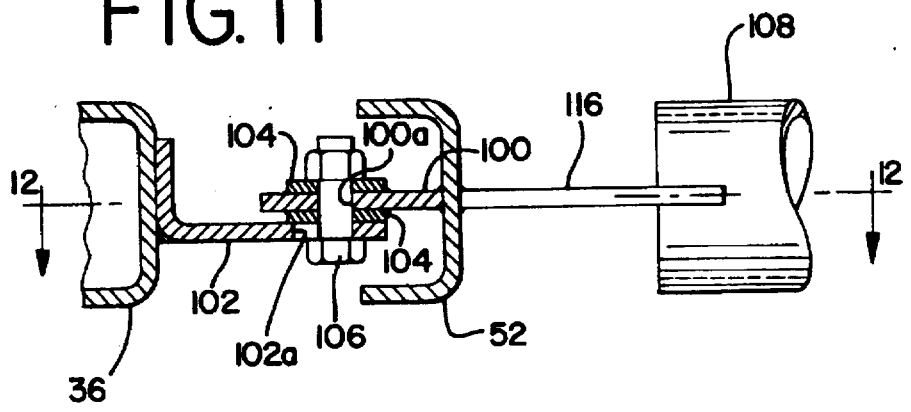
FIG. 11 is a fragmentary, cross-sectional view, taken substantially along lines 11—11 of FIG. 10.
Figure 12:
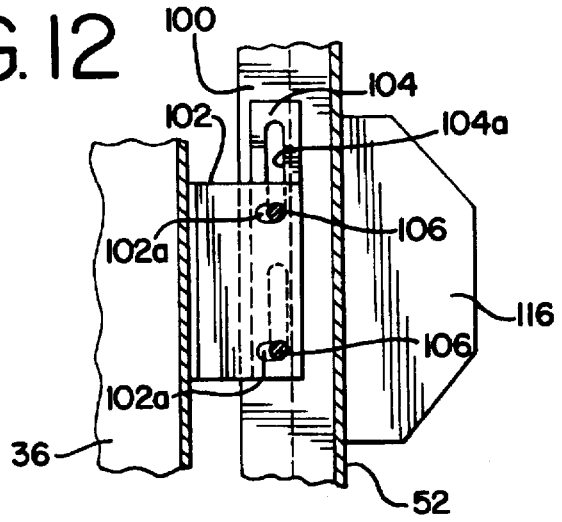
FIG. 12 is an enlarged, cross-sectional view, taken substantially along lines 12—12 of FIG. 11.
Figure 13:
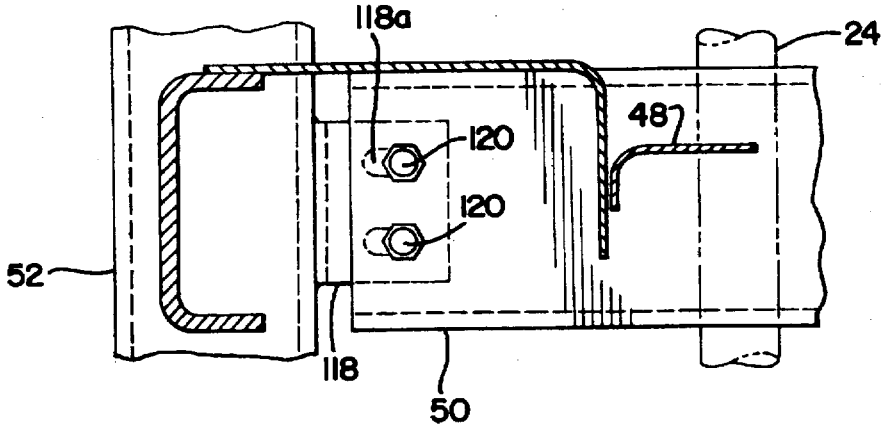
FIG. 13 is an enlarged, fragmentary, cross-sectional view, taken substantially along lines 13—13 of FIG. 10.

Each vertical chord 52 of the internal bracing trusses 54 has a channel-shaped transverse cross-section and a centrally disposed rib 100 is joined to the web of the channel (FIGS. 9–12) parallel of the channel flanges and extending outwardly toward an adjacent vertical external column 36 or 38. At appropriately spaced, vertical intervals, the columns 36 and 38 are provided with angle brackets 102 welded thereto having vertically spaced, horizontally extending slots 102*a* formed in ribs extending toward but offset from the ribs 100 on the chords 52 of the internal bracing trusses 54 as best shown in FIGS. 11 and 12.

At the levels of each bracket 102, the chord ribs 100 are provided with vertically slotted stiffening members 104 on opposite sides and the stiffening members have elongated vertical slots 104*a* therein aligned with similar slots 100*a* in the rib 100 to accommodate nut and bolt assemblies 106. The connecting structure thus formed between the ribs 100 and the brackets 102 permits a considerable amount of relative vertical displacement between the ribs 100 and the brackets 102 on the columns 36 and 38 and also permits a more limited amount of relative horizontal displacement owing to the shorter length of the horizontal slots 102*a* relative to the vertical slots 104*a*. This arrangement provides a positive slidable connection between the relatively hot internal bracing trusses 54 and the relatively cold external gravity support column pairs 36 and 38.

Referring to FIG. 1, each internal bracing truss 54 is designed to resist lateral bending by truss action transferring shear stress ultimately to the lower cross-member 42 via the lower cross-truss 66 and the shear transfer plate 92. At the same time, vertical expansion and contraction forces developed in the internal bracing trusses 54 and the tube bank 22 because of relative heating and cooling during operation of the HRSG 20 are accommodated and are ultimately transferred to the external (cold) gravity support columns 36 and 38.

Each internal bracing truss 54 includes a plurality of vertically spaced apart, horizontal cross-members 108 extending between opposite truss chords 52 and a plurality of diagonal cross-members 110 extending between the chords in opposite alternating directions to join the horizontal cross-members at corners of intersection with the chords. The cross-members 108 and 110 may be made of steel members having a round tubular transverse cross-section or other suitable structural shapes.

Figure 9:
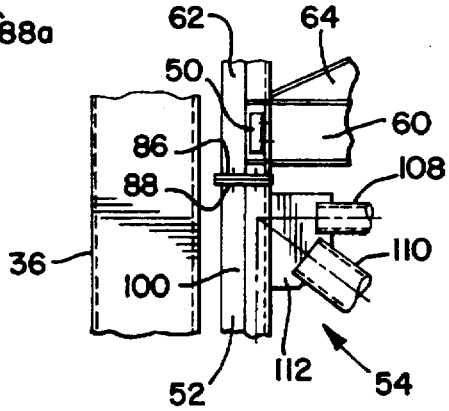
FIG. 9 is a fragmentary, enlarged, detailed elevational view illustrating interconnecting apparatus for upper ends of truss chords.

As shown in FIGS. 1 and 9, at upper left hand and lower right hand corners of the internal bracing trusses 54, the horizontal cross-members 108 and diagonal cross-members 110 are secured to corner brackets 112 welded to the web of the respective chords 52. At the upper right hand corner and the lower left hand corner of the trusses 54 (FIG. 1), the horizontal cross-members 108 are joined to side edge brackets 114 also welded to the web of the chords 52. At alternate levels up from the lower left hand corner of the trusses 54 and alternate levels down from the upper right hand corner, smaller side edge brackets 114 are also used for joining the horizontal cross-members 108 to the vertical chords 52. At alternate intermediate levels, generally semi-circular-shaped gusset plates 116 are provided on the chords 52 for joining a horizontal cross-member 108 and a pair of upwardly and downwardly sloping diagonal cross-members 110 as best shown in FIGS. 1, 10 and 12. At the level of each of the brackets 112, 114 and 116, the chords 52 of the internal bracing trusses 54 are slidably interconnected with the adjacent gravity support columns 36 or 38 by means of the angle brackets 102 as previously described.

Referring to FIG. 3, in order to accommodate horizontal expansion and contraction of the horizontal side channels 50 between the chords 52 on the respective upstream and downstream internal bracing truss 54, angle brackets 118 are welded to the chords and these brackets have ribs with horizontal slots 118*a* spaced vertically to accommodate nut and bolt assemblies 120 extending through apertures in the web of parallel channel member 50.

From the foregoing description, it is clear that gravity loads from internal hot components of the HRSG 20 are transferred and carried by the external (colder) upstream and downstream pairs of vertical columns 36 and 38. Because the tube bank 22 is supported from the upper end from the cross-trusses 56 carried by the columns 36 and 38, the lower end of the tube bank can move or float up and down in a vertical sense. Tendencies of the tubes 24 or the tube bank 22 as a whole to bend laterally are resisted by truss action of the vertically hanging internal (hot) bracing trusses 54. Lateral shear forces developed in these internal trusses are ultimately transferred via the shear plate 92 to the lower cross-member 42. The internal bracing trusses 54 and the interconnecting channel side members 60 protect the tube bank 22 from damage during shipment and during on-site erection. These trusses 54 do not require removal after erection is completed and play an important part in resisting lateral distortion of the tubes 24 during normal operation of the HRSG 20.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. Heat recovery steam generating apparatus for extracting heat from a hot gas stream, comprising:

a vertically extending tube bank having upper and lower headers at opposite ends;

pairs of external gravity force support columns spaced upstream and downstream of said tube bank including a top support structure at the upper end of said columns for supporting said tube bank in hanging relation from said upper header;

pairs of internal trusses connected at the upper end to said columns and having opposite edges slidably supported from said columns for accommodating expansion and contraction and for transferring and inserting lateral and shear loads to the lower end of said columns;

tube spacing elements at plural levels supported on side members extending between said trusses for maintaining alignment of the tubes in said tube bank and transferring lateral loads to said trusses; and bottom support structure between each pair of columns interconnected with lower ends of respective truss for transferring shear forces from said trusses to said columns.

2. The apparatus of claim 1, wherein:

said trusses are secured to said top support structure to hang downwardly therefrom and transfer gravity loading of said trusses to said columns.

3. The apparatus of claim 1, wherein:

each truss includes a vertically extending longitudinal member hanging at the upper end from said top structure and connected at the lower end to said bottom structure.

4. The apparatus of claim 3, wherein:

each truss includes a plurality of vertically spaced horizontal members connected at opposite ends to a pair of said longitudinal members.

5. The apparatus of claim 4, wherein:

each truss includes a plurality of diagonal members interconnected at opposite ends to a pair of longitudinal members.

6. The apparatus of claim 1, wherein:

said bottom support structure includes an upper member connected to the lower end of each truss and a lower member connected between pairs of said columns; and shear plate transfer means interconnected between said upper and lower members permitting relative vertical displacement but restraining relative horizontal displacement.

7. The apparatus of claim 1, wherein:

said top support structure includes a horizontal cross-member connected between upper ends of each pair of said columns; and a plurality of tube bank support members extending between said horizontal cross-members.

8. The apparatus of claim 1, wherein:

said tops support structure a frame member extending between each pair of columns and fixedly secured at opposite ends to said columns; and said trusses are connected to hang down from said frame members.

9. The apparatus of claim 1, wherein said tube spacing elements are slidably connected at opposite ends to said side members permitting movement toward and away from said trusses.

10. Heat recovery steam generating apparatus for extracting heat from a hot gas stream, comprising:

a plurality of parallel, vertically extending tubes in a tube bank joined to upper and lower headers at opposite ends of said tubes;

a plurality of pairs of gravity force supporting, vertical columns spaced upstream and downstream of said bank of tubes and laterally outwardly thereof and at least one horizontal upper cross-truss supported at opposite ends from upper end portions of a pair of said columns and means for supporting said bank of tubes in hanging relation from said cross-truss;

at least one vertical truss slidably connected at spaced intervals along opposite edges to a pair of said vertical columns spaced laterally outwardly of said bank of tubes; and tube spacing means at plural levels supported from said vertical truss for maintaining alignment of the tubes in said bank of tubes;

at least one lower horizontal cross-truss joined to the lower end of said vertical truss and extending between said pair of laterally spaced vertical columns; and a lower, horizontal base member joined at opposite ends to lower end portions of said pair of laterally spaced vertical columns; and shear force transfer means interconnecting said lower base member and said lower cross-truss for restraining relative lateral movement therebetween yet permitting relative vertical movement.

11. The apparatus of claim 10, wherein:

each vertical truss includes a pair of vertically extending longitudinal chords secured at upper ends to hang downwardly from said upper cross-truss.

12. The apparatus of claim 11, wherein:

each vertical truss includes a plurality of vertically spaced apart, horizontal cross-members connected at opposite ends to said longitudinal chords.

13. The apparatus of claim 12, wherein:

each vertical truss includes a plurality of diagonal cross-members interconnected at opposite ends to said longitudinal chords and a pair of said horizontal cross-members.

14. The apparatus of claim 12, wherein:

said chords of said vertical truss are secured to said vertical columns at spaced apart levels.

15. The apparatus of claim 14, wherein:

said chords are secured to said vertical columns adjacent the opposite ends of said horizontal cross-members.

16. The apparatus of claim 14, including:

connector means for securing said chords to said vertical columns permitting limited horizontal relative movement laterally between said columns.

17. The apparatus of claim 14, including:

connector means for securing said chords to said vertical columns permitting limited vertical relative movement therebetween.

* * * * *